US011855392B2

(12) United States Patent
Huang et al.

(10) Patent No.: US 11,855,392 B2
(45) Date of Patent: Dec. 26, 2023

(54) ELECTRICAL CONNECTOR

(71) Applicant: Cheng Uei Precision Industry Co., LTD., New Taipei (TW)

(72) Inventors: Gang Huang, Dong-Guan (CN); Bo Liu, Dong-Guan (CN)

(73) Assignee: CHENG UEI PRECISION INDUSTRY CO., LTD., New Taipei (TW)

( * ) Notice: Subject to any disclaimer, the term of this patent is extended or adjusted under 35 U.S.C. 154(b) by 133 days.

(21) Appl. No.: 17/572,519

(22) Filed: Jan. 10, 2022

(65) Prior Publication Data

US 2023/0178943 A1 Jun. 8, 2023

(30) Foreign Application Priority Data

Dec. 6, 2021 (CN) ..... 202123042621.0

(51) Int. Cl.

| | |
|---|---|
| ***H01R 24/30*** | (2011.01) |
| ***H01R 24/66*** | (2011.01) |
| ***H01R 13/52*** | (2006.01) |
| ***H01R 13/516*** | (2006.01) |

(52) U.S. Cl.

CPC ..... *H01R 24/30* (2013.01); *H01R 13/516* (2013.01); *H01R 13/52* (2013.01); *H01R 24/66* (2013.01)

(58) Field of Classification Search

CPC ..... H01R 24/30; H01R 24/66; H01R 13/516; H01R 13/514; H01R 13/50; H01R 13/52; H01R 13/46

USPC ..... 439/699.2, 702

See application file for complete search history.

(56) References Cited

U.S. PATENT DOCUMENTS

| | | | | |
|---|---|---|---|---|
| 4,804,343 | A * | 2/1989 | Reedy | H01R 33/06 439/336 |
| 5,156,560 | A * | 10/1992 | Thomas | H01R 33/06 439/877 |
| 5,709,571 | A * | 1/1998 | Briski | H01R 33/09 439/619 |
| 6,843,673 | B1 * | 1/2005 | Liu | H01R 24/46 439/63 |
| 6,932,615 | B1 * | 8/2005 | Yeo | H01R 24/46 439/63 |
| 7,063,556 | B1 * | 6/2006 | Wong | H01R 4/2408 439/417 |
| 7,153,171 | B1 * | 12/2006 | Goto | H01R 33/09 439/699.2 |
| 7,479,044 | B1 * | 1/2009 | MacCrindle | H01R 33/09 439/942 |
| 7,513,778 | B1 * | 4/2009 | Dar-Shan | H01R 24/50 439/63 |

(Continued)

*Primary Examiner* — Harshad C Patel
(74) *Attorney, Agent, or Firm* — Cheng-Ju Chiang

(57) ABSTRACT

An electrical connector includes an insulating housing, a power leg, a ground leg, a power contact and a ground contact. The insulating housing has a peripheral wall. At least two perforations are defined on the peripheral wall. At least two leg recesses are formed on the peripheral wall. The perforations and the leg recesses are staggered along the peripheral wall. The power leg and the ground leg are both received in the peripheral wall of the insulating housing and are both have leg portions being exposed from the leg recesses. The power contact and the ground contact are both located in the perforations. As described above, manufacture material of the electrical connector is saved.

15 Claims, 5 Drawing Sheets

(56) References Cited

U.S. PATENT DOCUMENTS

| | | | | |
|---|---|---|---|---|
| 7,635,279 | B1 * | 12/2009 | Wong | H01R 4/48365 439/419 |
| 8,113,857 | B1 * | 2/2012 | Huang | H01R 24/50 439/188 |
| 9,236,695 | B2 * | 1/2016 | Hoshiba | H01R 24/46 |
| 9,362,672 | B1 * | 6/2016 | Sun | H01R 13/625 |
| 9,385,492 | B2 * | 7/2016 | Chen | H01R 24/46 |
| 9,692,165 | B2 * | 6/2017 | Matoba | H01R 24/38 |
| 10,020,604 | B2 * | 7/2018 | Vo | H01R 13/62 |
| 2009/0130868 | A1 * | 5/2009 | Schenk | H01R 4/183 335/281 |
| 2010/0227481 | A1 * | 9/2010 | Liao | H01R 24/46 439/63 |

* cited by examiner

ELECTRICAL CONNECTOR

CROSS-REFERENCE TO RELATED APPLICATION

The present application is based on, and claims priority from, China Patent Application No. 202123042621.0, filed Dec. 6, 2021, the disclosure of which is hereby incorporated by reference herein in its entirety.

BACKGROUND OF THE INVENTION

1. Field of the Invention

The present invention generally relates to an electrical connector, and more particularly to an electrical connector for a bluetooth headset.

2. The Related Art

A bluetooth headset has an electrical connector for receiving power. A ground contact and a power contact of a conventional electrical connector is formed through a computer numerical control (CNC) process. In an electroplating process, soldering legs of the ground contact and the power contact are shielded first, and then the soldering legs are electroplated rhodium-ruthenium alloy. Finally, the shielding of the soldering legs is removed by a chemical liquid. So that the soldering legs can be electroplated gold, and electroplating layers of the other parts of the ground contact and the power contact are rhodium-ruthenium alloy.

However, manufacturing process of the conventional electrical connector is complicated because a shielding material and a removing chemical liquid are used in the electroplating process.

Therefore, it is necessary to provide an innovative electrical connector for the bluetooth headset, the manufacture efficiency of the electrical connector is improved, and manufacture material of the electrical connector is saved.

SUMMARY OF THE INVENTION

An object of the present invention is to provide an electrical connector. The electrical connector includes an insulating housing, a power leg, a ground leg, a power contact and a ground contact. The insulating housing has a peripheral wall. At least two perforations are defined on the peripheral wall. At least two leg recesses are formed on the peripheral wall. The perforations and the leg recesses are staggered along the peripheral wall. The power leg is received in the peripheral wall of the insulating housing. The power leg has a leg portion being exposed from one of the leg recesses. The ground leg is received in the peripheral wall of the insulating housing. The ground leg has a leg portion being exposed from the other of the leg recesses. The power contact is connected to the power leg and positioned under the power leg. The power contact is located in one of the perforations. The ground contact is connected to the ground leg and positioned under the ground leg. The ground contact is located in the other of the perforations.

Another object of the present invention is to provide a manufacturing method of an electrical connector. The method of manufacturing the electrical connector comprises steps of: positioning a power contact under a power leg, positioning a ground leg under a ground contact; soldering the power leg with the power contact to form a power terminal, soldering the ground leg with the ground contact to form a ground terminal; and insert molding the power terminal and the ground terminal with an insulating housing, exposing leg portions of the power terminal and ground terminal from leg recesses of a peripheral wall of the insulating housing, exposing the power contact and the ground contact from perforations of the peripheral wall of the insulating housing, the perforations and the leg recesses being staggered along the peripheral wall.

Another object of the present invention is to provide an electrical connector. The electrical connector includes an insulating housing, a leg, a contact and a bracket. The insulating housing has an accommodating space. A peripheral wall surrounds the accommodating space. At least one perforation is formed on the peripheral wall and at least one leg recess is formed on the peripheral wall. A leg is electroplated. The leg has a connection portion. A leg portion is extended from one end of the leg and a fixing portion is extended from the connection portion. A contact is electroplated. The contact has a fixing recess being formed on a top of the contact. A bracket is received in the accommodating space. After the leg and the contact are electroplated. The contact is positioned under the leg. The fixing portion is assembled in the fixing recess. The contact is soldered with the leg. The connection portion, the fixing portion and the fixing recess are molded in the peripheral wall. The leg portion is exposed from the leg recess. The contact is exposed from the perforation.

As described above, the power leg, the ground leg, the power contact and the ground contact can be electroplated before the power leg is soldered to the power contact and the ground leg is soldered to the ground contact. So that the shielding material in the prior art is omitted. Hence, manufacture efficiency of the electrical connector is improved, and manufacture material of the electrical connector is saved.

BRIEF DESCRIPTION OF THE DRAWINGS

The present invention will be apparent to those skilled in the art by reading the following description, with reference to the attached drawings, in which.

DETAILED DESCRIPTION OF THE PREFERRED EMBODIMENT

Figure 1:
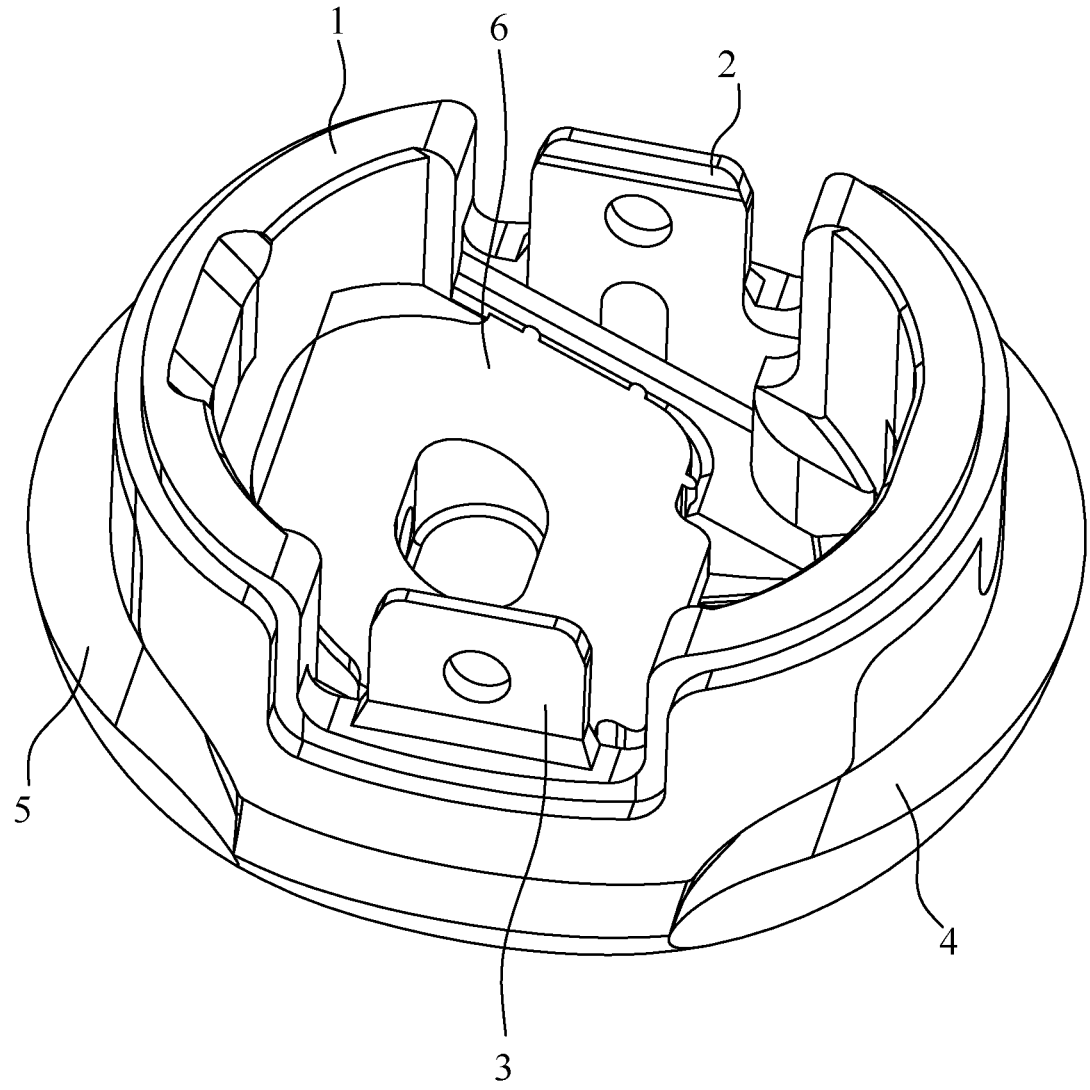
FIG. 1 is a perspective view of an electrical connector for a bluetooth headset in accordance with a preferred embodiment of the present invention.
Figure 2:
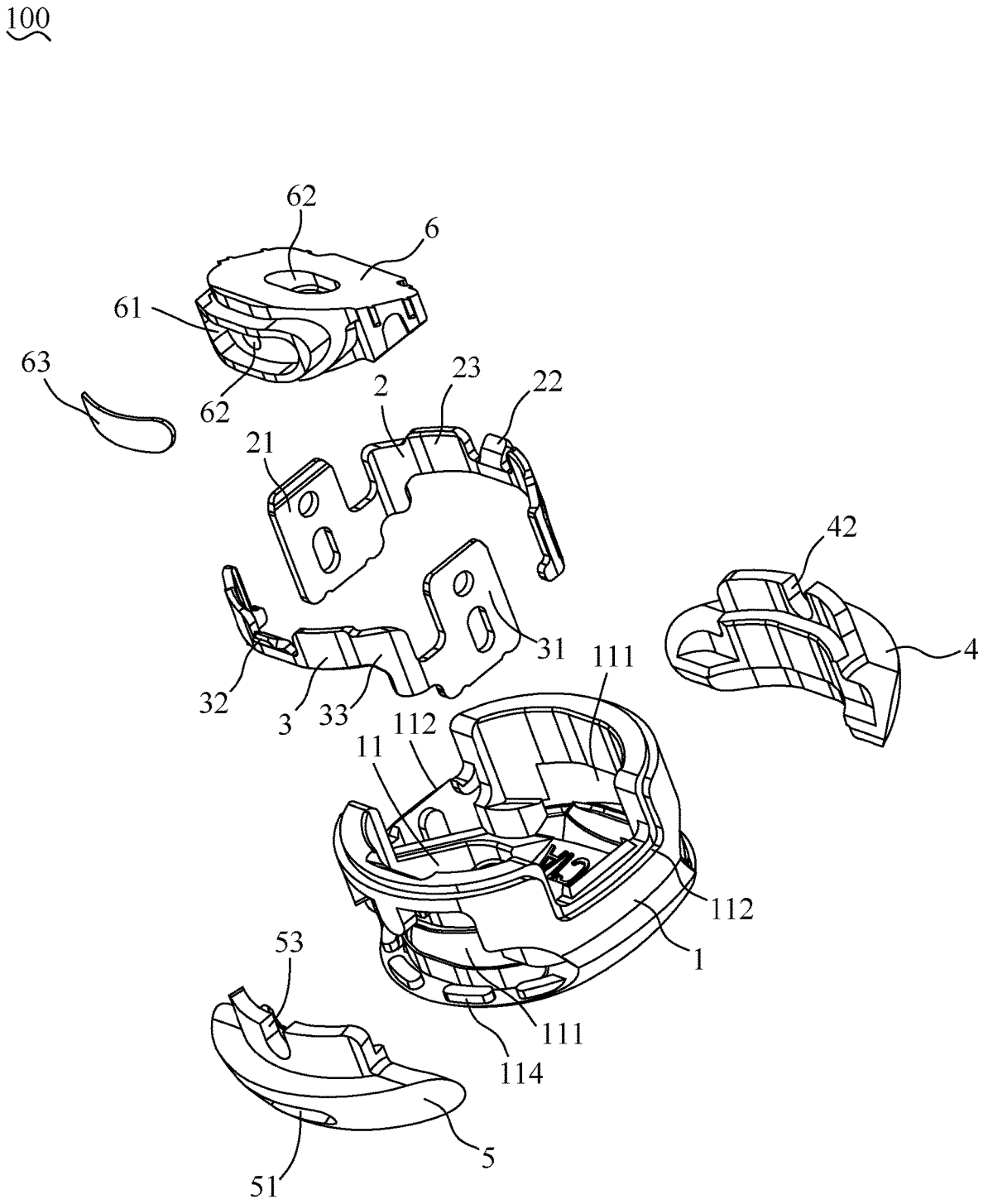
FIG. 2 is an exploded view of the electrical connector of FIG. 1.

With reference to FIG. 1 and FIG. 2, an electrical connector 100 in accordance with a preferred embodiment of the present invention is shown. The electrical connector 100 is used for a bluetooth headset. The electrical connector 100 includes an insulating housing 1, a power leg 2, a ground leg 3, a power contact 4, a ground contact 5 and a bracket 6.

Referring to FIG. 1 and FIG. 2, the insulating housing 1 has an accommodating space 11 being recessed inward. The accommodating space 11 is surrounded by a peripheral wall. The peripheral wall is formed a circular shape. The peripheral wall has two perforations 111 being penetrated the peripheral wall. The perforations are opposite to each other. The peripheral wall has two leg recesses 112. The leg recesses 112 are penetrated the peripheral wall and opened from a top edge of peripheral wall. The leg recesses 112 are opposite to each other. The perforations 111 and the leg recesses 112 are staggered along the peripheral wall. A bottom surface of each of the perforations 111 has at least one fixing bump 114. In this embodiment, four fixing bumps 114 are protruded upward from the bottom surface of the perforation 111.

Figure 4:
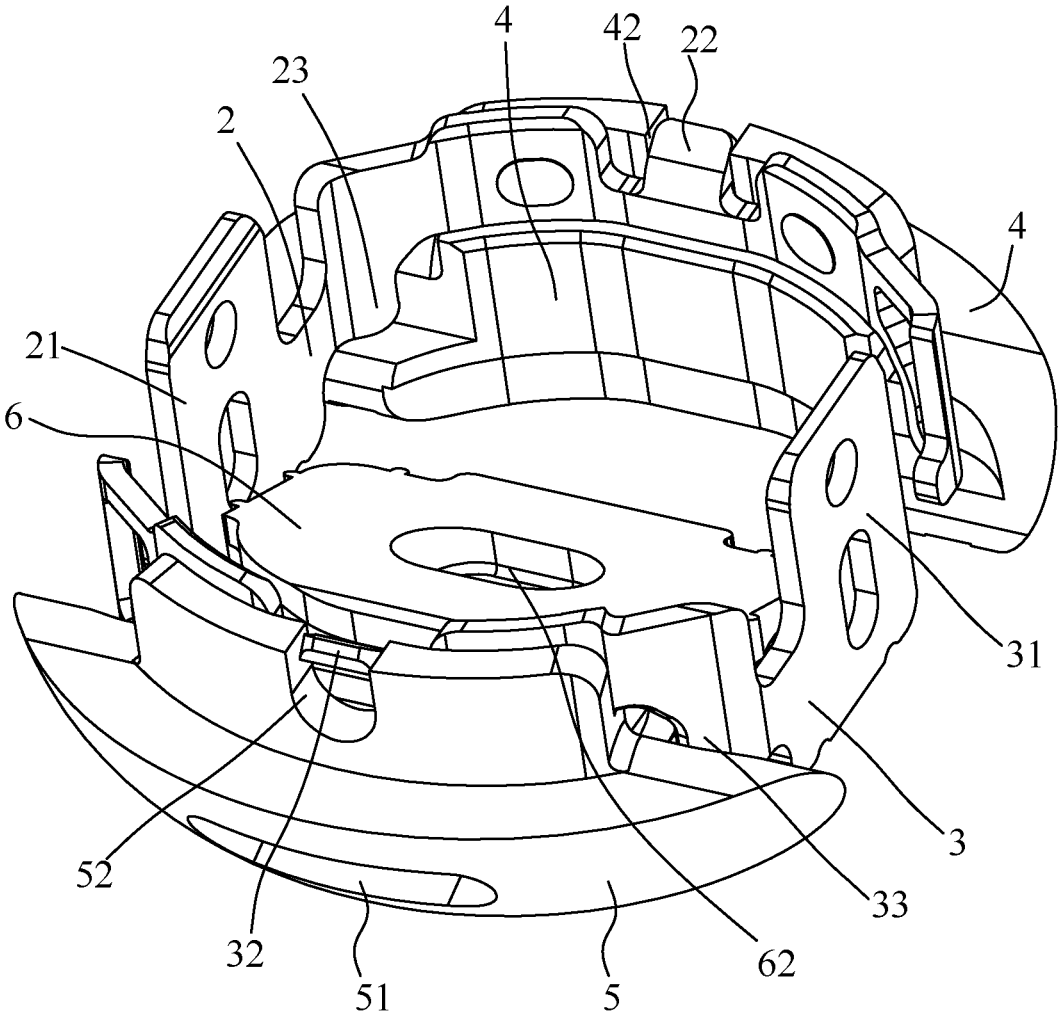
FIG. 4 is a perspective view showing that a ground terminal and a power terminal are assembled in accordance with the preferred embodiment of the present invention.

Referring to FIG. 2 and FIG. 4, the power leg 2 and the ground leg 3 are both received in the insulating housing 1, and parts of the power leg 2 and the ground leg 3 are exposed from the perforations 111 respectively. In the preferred embodiment, the power leg 2 and the ground leg 3 are both insert molded in the peripheral wall of the insulating housing 1, and the power leg 2 and the ground leg 3 are insulated to each other.

Referring to FIG. 2 and FIG. 4, the power leg 2 has a leg portion 21, a fixing portion 22 and a connection portion 23. The leg portion 21 is extended from one end of the fixing portion 23. The fixing portion 22 is extended from a middle of a top edge of the connection portion 23. The fixing portion 22 is bent outward and protruded beyond an outer surface of the connection portion 23. The leg portion 21 is received in one of the leg recesses 112. The fixing portion 22 and the connection portion 23 are molded in the peripheral wall of the insulating housing 1. The ground leg 3 has a leg portion 31, a fixing portion 32 and a connection portion 33. The leg portion 31 is extended from one end of the fixing portion 33. The fixing portion 32 is extended from a middle of a top edge of the connection portion 33. The fixing portion 32 is bent outward and protruded beyond an outer surface of the connection portion 33. The leg portion 31 is received in the other of the leg recesses 112. The fixing portion 32 and the connection portion 33 are molded in the peripheral wall of the insulating housing 1.

Figure 3:
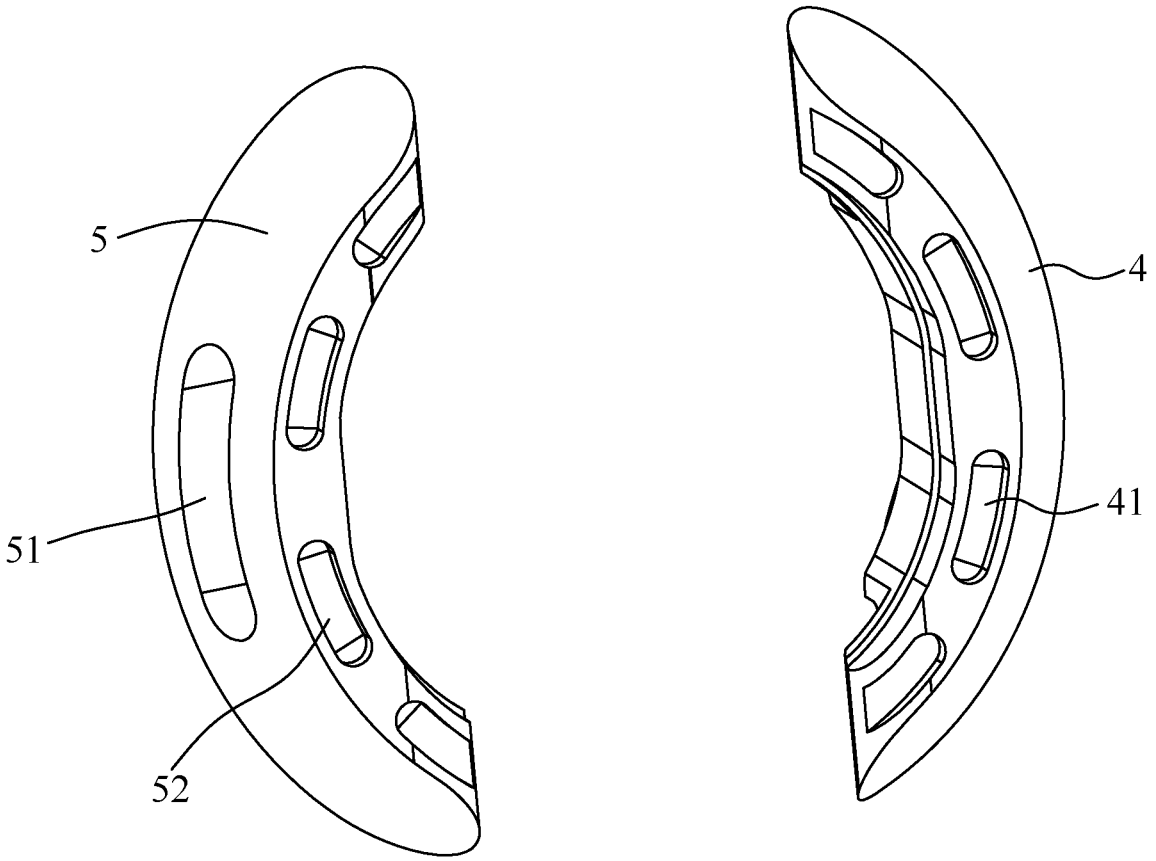
FIG. 3 is a perspective view of a ground contact and a power contact of the electrical connector in accordance with the preferred embodiment of the present invention.

Referring to FIG. 2 to FIG. 4, the power contact 4 is located in one of the perforations 111 and positioned under the connection portion 23 of the power leg 2. The power contact 4 is soldered with the power leg 2. The power contact 4 has at least one concave portion 41 being formed inward from a bottom surface of the power contact 4. In this embodiment, four concave portions 41 are formed on the bottom surface of the power contact 4 for receiving the fixing bumps 114. So that the power contact 4 can be fixed in the perforation 111. A fixing recess 42 is formed from a top edge of the power contact 4. The fixing portion 22 of the power leg 2 is assembled in the fixing recess 42 of the power contact 4.

Referring to FIG. 2 to FIG. 4, the ground contact 5 is located in the other of the perforations 111 and positioned under the connection portion 33 of the ground leg 3. The ground contact 5 is soldered with the ground leg 3. The ground contact 5 has at least one concave portion 52 being formed inward from a bottom surface of the ground contact 5. In this embodiment, four concave portions 52 are formed on the bottom surface of the ground contact 5 for receiving the fixing bumps 114. So that the ground contact 5 can be fixed in the perforation 111. A fixing recess 53 is formed from a top edge of the ground contact 5. The fixing portion 32 of the ground leg 3 is assembled in the fixing recess 53 of the ground contact 5. The ground contact 5 further has a mouth 51 formed on an outer surface of the ground contact 5. The mouth 51 is penetrated the ground contact 5.

Referring to FIG. 2 and FIG. 4, the bracket 6 is received in the accommodating space 11. A slot 61 is formed on an outer surface of the bracket 6. A groove 62 is formed in the bracket 6. One end of the groove 62 is opened from a top surface of the bracket 6, and the other end of the groove 62 is opened from a side surface of the slot 61. The slot 61 is corresponding to the mouth 51 of the ground contact 5, so that the groove 62 of the bracket 6 is corresponding to the mouth 51 of the ground contact 5. A dustproof film 63 is mounted in the slot 61. The dustproof film 63 is made of a web material and a pressure sensitive adhesive. The dustproof film 63 can prevent dust from being entered into the electrical connector 100 through the groove 62. Ambient sound can be transmitted into the electrical connector 100 through the groove 62. Therefore, when the electrical connector 100 is used in the bluetooth headset, the dustproof film 63 prevents dust from being entered into the bluetooth headset, and allows ambient sound to transmit into the bluetooth headset. The bracket 6 is fixed in the accommodating space 11 by glue, and the glue has waterproof function.

A method of manufacturing the electrical connector 100 comprises steps of: assembling the fixing portion 22 of the power leg 2 into the fixing recess 42 of the power contact 4, and then soldering the power leg 2 with the power contact 4 to form a power terminal; assembling the fixing portion 32 of the ground leg 3 into the fixing recess 53 of the ground contact 5, and then soldering the ground leg 3 with the ground contact 5 to form a ground terminal; inset molding the power terminal and the ground terminal with the insulating housing 1; positioning the dustproof film 63 in the slot 61 of the bracket 6; positioning the bracket 6 in the accommodating space 11 of the insulating housing 1 and aligning the slot 61 of the bracket 6 with the mouth 51 of the grounding contact 5; and gluing the bracket 6 with the insulating housing 1. So manufacturing process of the electrical connector 100 is finished.

In the preferred embodiment, before the power leg 2 is soldered with the power contact 4, and the ground leg 3 is soldered with the ground contact 5, the power leg 2, the ground leg 3, the power contact 4 and the ground contact 5 are electroplated through a barrel plating process. So that shielding material in the prior art is omitted. The manufacture material of the electrical connector 100 is saved.

When the electrical connector 100 is assembled to the bluetooth headset, the leg portion 21 of the power leg 2 is connected to a positive electrode of the bluetooth headset, and the leg portion 31 of the ground leg 3 is connected to a negative electrode of the bluetooth headset.

When the bluetooth headset is positioned in a charging case, a power pin of the charging case is connected to the power contact 4 and a ground pin of the charging case is connected to the ground contact 5 respectively, so that the power pin of the charging case is electrically coupled to the positive electrode of the bluetooth headset by the power contact 4 and the power leg 2 of the power terminal. The grounding pin is electrically coupled to the negative electrode of the bluetooth headset by the ground contact 5 and the ground leg 3 of the ground terminal. So that the bluetooth headset can be charged by the charging case.

When the electrical connector 100 is assembled to the bluetooth headset, ambient sound can be transmitted to a microphone of the bluetooth headset via the mouth 51 of the ground contact 5 and the groove 62 of the bracket 6.

Figure 5:
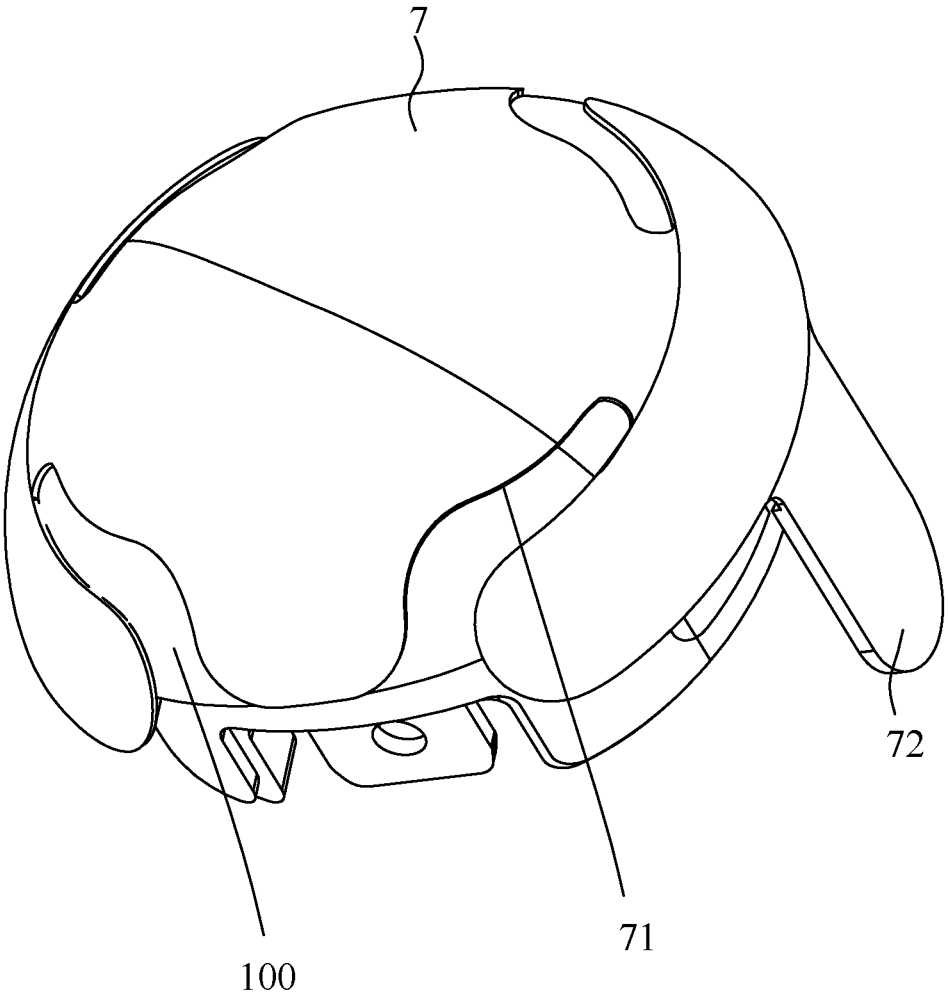
FIG. 5 is a perspective view of the electrical connector being covered a protective film in accordance with the preferred embodiment of the present invention.

Referring to FIG. 5, the electrical connector 100 further comprises a protective film 7. The protective film 7 is mounted on a bottom surface of the insulating housing 1. A cut 71 is opened at the protective film 7. Because the bottom surface of the insulating housing 1 is circular shape, the protective film 7 is fitted with the circular shape bottom surface of the insulating housing 1 by the cut 71. An operation portion 72 is extended outward from the protective film 7, so that user is easy to remove the protective film 7 by the operation portion 72. The protective film 7 can prevent an appearance surface of the electrical connector 100 from being scratched in transportation and manufacturing processes.

As described above, the power leg 2, the ground leg 3, the power contact 4 and the ground contact 5 can be electroplated before the power leg 2 is soldered to the power contact 4 and the ground leg 3 is soldered to the ground contact 5. So that the shielding material in the prior art is omitted. Hence, manufacture efficiency of the electrical connector 100 is improved, and manufacture material of the electrical connector 100 is saved.

What is claimed is:

1. An electrical connector, comprising:

an insulating housing having a peripheral wall, at least two perforations being defined on the peripheral wall and at least two leg recesses being formed on the peripheral wall, the perforations and the leg recesses being staggered along the peripheral wall;

a power leg being received in the peripheral wall of the insulating housing, the power leg having a leg portion being exposed from one of the leg recesses;

a ground leg being received in the peripheral wall of the insulating housing, the ground leg having a leg portion being exposed from the other of the leg recesses;

a power contact being connected to the power leg and positioned under the power leg, the power contact being located in one of the perforations; and a ground contact being connected to the ground leg and positioned under the ground leg, the ground contact being located in the other of the perforations.

2. The electrical connector as claimed in claim 1, wherein at least one bump is extended from a bottom surface of each of the perforations of the insulating housing, at least one concave portion is formed on a bottom surface of each of the power contact and the ground contact, the bump is fixed in the concave portion.

3. The electrical connector as claimed in claim 1, wherein the power leg has a connection portion, the leg portion of the power leg is extended from one end of the connection portion of the power leg, the power leg has a fixing portion being extended from a top edge of the connection portion of the power leg and bent outward, the power contact has a fixing recess being formed on a top edge of the power contact, the fixing portion of the power leg is assembled in the fixing recess of the power contact.

4. The electrical connector as claimed in claim 1, wherein the ground leg has a connection portion, the leg portion of the ground leg is extended from one end of the connection portion of the ground leg, the ground leg has a fixing portion being extended from a top edge of the connection portion of the ground leg and bent outward, the ground contact has a fixing recess being formed on a top edge of the ground contact, the fixing portion of the ground leg is assembled in the fixing recess of the ground contact.

5. The electrical connector as claimed in claim 1, wherein the ground contact has a mouth being opened at an outer surface of the ground contact and penetrated the ground contact.

6. The electrical connector as claimed in claim 5, wherein the insulating housing has an accommodating space being surrounded by the peripheral wall, the perforations are communicated with the accommodating space, the accommodating space receives a bracket, the bracket has a groove, one end of the groove is opened on a side surface of the bracket and corresponding to the mouth of the ground contact, the other end of the groove is opened on another side of the bracket.

7. The electrical connector as claimed in claim 6, wherein the bracket has a slot formed on the side surface of the bracket, the slot is communicated with the one end of the groove, the slot receives a dustproof film, the dustproof film is positioned between the mouth of the ground contact and the one end of the groove.

8. The electrical connector as claimed in claim 7, wherein the dustproof film is made of a web material and a pressure sensitive adhesive.

9. The electrical connector as claimed in claim 5, wherein a glue is applied between the bracket and the insulating housing.

10. The electrical connector as claimed in claim 1, further comprising a protective film being mounted on a bottom surface of the insulating housing.

11. The electrical connector as claimed in claim 10, wherein the bottom surface of the insulating housing is circular shape, a cut is opened at the protective film, so that the protective film is fitted with the circular shape bottom surface of the insulating housing by the cut.

12. The electrical connector as claimed in claim 11, wherein an operation portion is extended from the protective film.

13. An electrical connector, comprising:

an insulating housing having an accommodating space, a peripheral wall surrounding the accommodating space, at least one perforation being formed on the peripheral wall and at least one leg recess being formed on the peripheral wall;

a leg being electroplated, the leg having a connection portion, a leg portion being extended from one end of the leg and a fixing portion extended from the connection portion;

a contact being electroplated, the contact having a fixing recess being formed on a top of the contact;

a bracket being received in the accommodating space;

wherein after the leg and the contact are electroplated, the contact is positioned under the leg, the fixing portion is assembled in the fixing recess, the contact is soldered with the leg, the connection portion, the fixing portion and the fixing recess are molded in the peripheral wall, the leg portion is exposed from the leg recess, the contact is exposed from the perforation.

14. The electrical connector as claimed in claim 13, wherein the contact has a mouth being penetrated the contact, the bracket has a groove, one end of the groove is opened on a side surface of the bracket and corresponding to the mouth, the other end of the groove is opened on another side of the bracket.

15. The electrical connector as claimed in claim 14, wherein the bracket has a slot formed on the side surface of the bracket, the slot is communicated with the one end of the groove, the slot receives a dustproof film, the dustproof film is positioned between the mouth and the one end of the groove.

* * * * *